US009605403B1

(12) United States Patent
Putnam

(10) Patent No.: US 9,605,403 B1
(45) Date of Patent: Mar. 28, 2017

(54) VENTED PRECIPITATION GUARDING MANHOLE COVER ASSEMBLIES

(71) Applicant: David Putnam, Calhoun, LA (US)

(72) Inventor: David Putnam, Calhoun, LA (US)

( * ) Notice: Subject to any disclaimer, the term of this patent is extended or adjusted under 35 U.S.C. 154(b) by 115 days.

(21) Appl. No.: 14/728,016

(22) Filed: Jun. 2, 2015

(51) Int. Cl.
*E02D 29/00* (2006.01)
*E02D 29/14* (2006.01)

(52) U.S. Cl.
CPC ..... *E02D 29/1436* (2013.01); *E02D 29/14* (2013.01); *E02D 29/149* (2013.01)

(58) Field of Classification Search
CPC .... E02D 29/1436; E02D 19/14; E02D 19/149
USPC ..... 404/25, 26; 52/19, 20
See application file for complete search history.

(56) References Cited

U.S. PATENT DOCUMENTS 574,992 A * 1/1897 Held ..... F16K 15/20 137/232
576,253 A * 2/1897 Bingham ..... F24F 13/02 454/48
2,009,132 A * 7/1935 Gehris ..... E02D 29/1427 220/315
3,712,009 A * 1/1973 Campagna ..... E02D 29/14 404/25
3,798,848 A 3/1974 Campagna
3,920,347 A * 11/1975 Sauriol ..... E02D 29/14 210/166
3,973,856 A * 8/1976 Gaglioti ..... E02D 29/14 210/163
4,067,659 A 1/1978 Campagna, Jr. et al.
4,305,679 A * 12/1981 Modi ..... E02D 29/14 210/165
4,512,492 A 4/1985 Graybeal
4,586,941 A * 5/1986 Cooley ..... B01D 53/02 55/385.1
4,597,692 A * 7/1986 Gruenwald ..... E02D 29/149 220/287
4,650,365 A * 3/1987 Runnels ..... E02D 29/14 404/25
4,762,440 A * 8/1988 Argandona ..... B65D 90/105 137/312
4,768,675 A 9/1988 Coleman
4,919,564 A * 4/1990 Neathery ..... E02D 29/14 277/648
5,727,351 A 3/1998 Neathery et al.
5,846,274 A 12/1998 Smelser
5,924,846 A 7/1999 Arnold, Jr. et al.
6,848,465 B1 2/2005 Ledbetter
8,851,791 B1 10/2014 Putnam
2012/0227168 A1 9/2012 Paoluccio et al.

* cited by examiner

*Primary Examiner* — Raymond W Addie
(74) *Attorney, Agent, or Firm* — R. Keith Harrison

(57) ABSTRACT

Vented precipitation guarding manhole cover assemblies include a manhole cover having a manhole cover protrusion. The manhole cover protrusion has a protrusion edge, a protrusion surface contiguous with and extending from the protrusion edge and a protrusion apex contiguous with the protrusion surface. A manhole cover vent opening extends through the manhole cover protrusion and the manhole cover.

16 Claims, 10 Drawing Sheets

VENTED PRECIPITATION GUARDING MANHOLE COVER ASSEMBLIES

FIELD

Illustrative embodiments of the disclosure generally relate to manhole covers for manhole openings which overlie sewer systems. More particularly, illustrative embodiments of the disclosure relate to vented precipitation guarding manhole cover assemblies which close a manhole opening in a manhole structure above a sanitary sewer and vent sewer gas from the sewer as well as prevent or limit flow of precipitation into and overflow of storm water from the sewer.

BACKGROUND

The background description provided herein is solely for the purpose of generally presenting the context of the illustrative embodiments of the disclosure. Aspects of the background description are neither expressly nor impliedly admitted as prior art against the claimed subject matter.

Sanitary sewers are subterranean tunnels which transport raw sewage from houses and commercial buildings to a treatment or disposal facility. Sewers may include pipelines which connect houses and buildings to one or more levels of larger underground trunk mains. Manholes are periodically-shaped vertical openings which connect the trunk mains to the ground surface for sewer gas venting and other purposes. Manhole covers are plates which are seated in manhole openings at the ground surface to close the manholes. The manhole covers can be selectively unseated from the manhole openings to provide access to the underlying subterranean sewer structure for cleaning, maintenance or repair.

Vented precipitation guarding manhole cover assemblies which close a manhole opening in a manhole structure above a sanitary sewer and vent sewer gas from the sewer as well as prevent or limit flow of precipitation into and overflow of storm water from the sewer may be desirable for some applications.

SUMMARY

Illustrative embodiments of the disclosure are generally directed to vented precipitation guarding manhole cover assemblies which close a manhole opening in a manhole structure above a sanitary sewer and vent sewer gas from the sewer and prevent or limit flow of precipitation into the sewer and overflow of storm water from the sewer. In some embodiments, the vented precipitation guarding manhole cover assemblies may include a manhole cover having a generally planar exterior manhole cover surface and a manhole cover protrusion extending from the exterior manhole cover surface. The manhole cover protrusion has a protrusion edge contiguous with the exterior manhole cover surface. A protrusion surface of the manhole cover protrusion is contiguous with and extends from the protrusion edge. A protrusion apex of the manhole cover protrusion is contiguous with the protrusion surface. A manhole cover vent opening extends through the manhole cover protrusion and the manhole cover.

In some embodiments, the vented precipitation guarding manhole cover assemblies may include a manhole cover having a manhole cover edge; a manhole cover protrusion having a protrusion edge contiguous with the manhole cover edge, a generally convex protrusion surface contiguous with and extending from the protrusion edge and a protrusion apex contiguous with the protrusion surface; and a manhole cover vent opening extending through the manhole cover protrusion and the manhole cover.

BRIEF DESCRIPTION OF THE DRAWINGS

Illustrative embodiments of the disclosure will now be described, by way of example, with reference to the accompanying drawings, in which.

DETAILED DESCRIPTION

Figure 10:
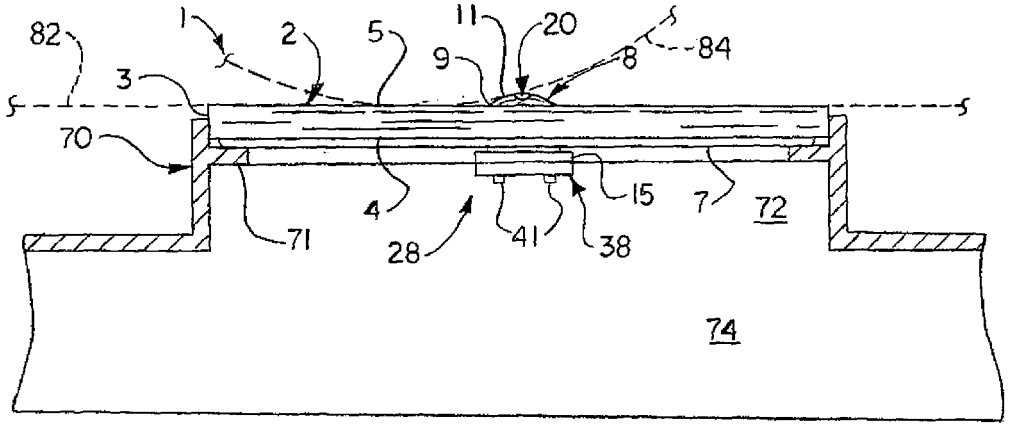
FIG. 10 is a side view of the illustrative vented precipitation guarding manhole cover assembly with the vent valve illustrated in FIG. 9, deployed in place on the manhole flange in the manhole structure.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable users skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description. Relative terms such as "interior" and "exterior" are intended to be descriptive and are not intended to be limiting in any manner. For purposes of description herein, such relative terms relate to the position of the vented precipitation guarding manhole cover assembly as illustrated in FIG. 10.

Referring initially to FIGS. 1-15 of the drawings, an illustrative embodiment of the vented precipitation guarding manhole cover assemblies, hereinafter assembly, is generally indicated by reference numeral 1. As illustrated in FIGS. 9 and 10 and will be hereinafter further described, in typical application, the assembly 1 is configured to be mounted in a manhole structure 70 having a manhole shoulder 71 in a manhole opening 72 which in some applications may extend into the ground or a roadway surface 82 (FIG. 10) and communicates with a sanitary sewer 74 beneath the ground or a roadway surface 82. The assembly 1 vents or discharges sewer gas 60 (FIG. 11) such as hydrogen sulfide and mercaptan, for example and without limitation, from the sewer 74 to the atmosphere 66, as well as prevents or substantially limits the quantity of falling precipitation 78 (FIG. 11) from the atmosphere 66 and/or pooled precipitation 76 from the ground or roadway surface 82 which enters the sewer 74 through the manhole opening 72. The assembly 1 may further prevent storm water 80 (FIG. 12) from rising from the sewer 74, overflowing the manhole opening 72 and flooding or contaminating the ground or roadway surface 82, particularly under heavy precipitation conditions. As illustrated in FIG. 15, in some applications, the assembly 1 may deodorize odiferous sewer gas 60 from the sewer 74 and release the deodorized sewer gas 62 into the atmosphere 66.

Figure 1:
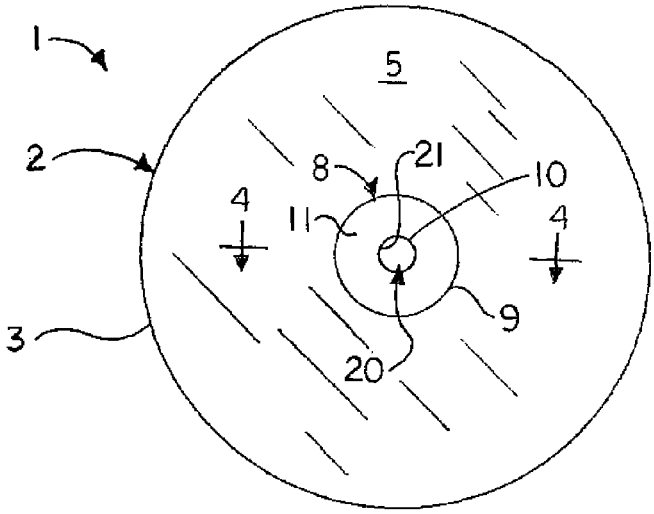
FIG. 1 is a top view of an illustrative embodiment of the vented precipitation guarding manhole cover assemblies.
Figure 2:
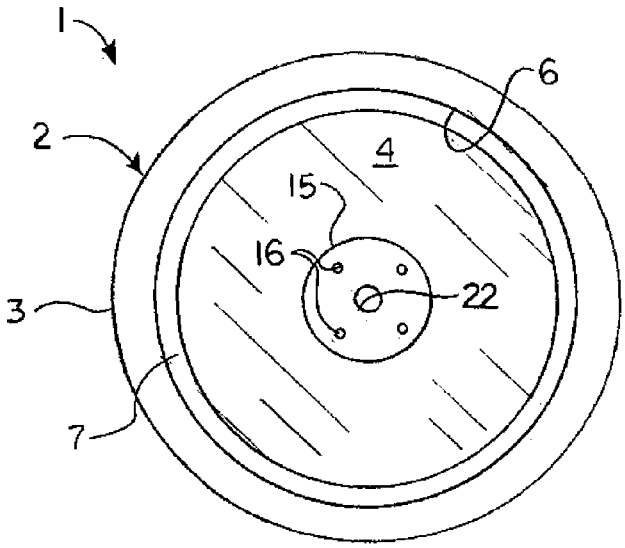
FIG. 2 is a bottom view of an illustrative embodiment of the vented precipitation guarding manhole cover assemblies.
Figure 3:
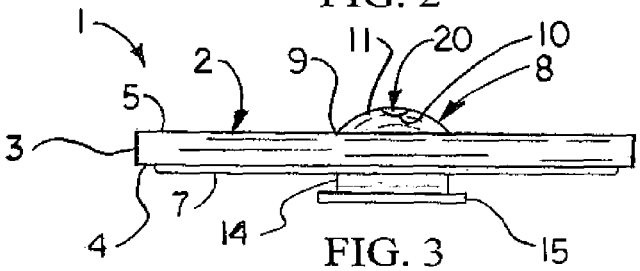
FIG. 3 is a side view of an illustrative embodiment of the vented precipitation guarding manhole cover assemblies.

As particularly illustrated in FIGS. 1-6, the assembly 1 may include a manhole cover 2. The manhole cover 2 may include steel, aluminum, carbon fiber composite, inert plastic or other suitable material, or any combination thereof. The manhole cover 2 may have an interior manhole cover surface 4 which faces the manhole opening 72 (FIG. 10), a generally planar exterior manhole cover surface 5 which faces the atmosphere 66 and an annular manhole cover edge 3 which circumscribes the interior manhole cover surface 4 and the exterior manhole cover surface 5 and faces the manhole structure 70 when the manhole cover 2 is seated on the manhole shoulder 71. As illustrated in FIG. 2, at least one annular cover seal groove 6 may be provided in the interior manhole cover surface 4. At least one annular manhole cover seal 7 may be provided in the cover seal groove 6 for sealing purposes. The manhole cover seal 7 may include any type of sealing element which is capable of imparting a fluid-tight seal between the manhole cover 2 and the manhole shoulder 71 (FIG. 10) of the manhole structure 70 when the manhole cover 2 seats on the manhole shoulder 71. In some embodiments, the manhole cover seal 7 may include at least one gasket or O-ring, for example and without limitation, as is known by those skilled in the art.

Figure 4:
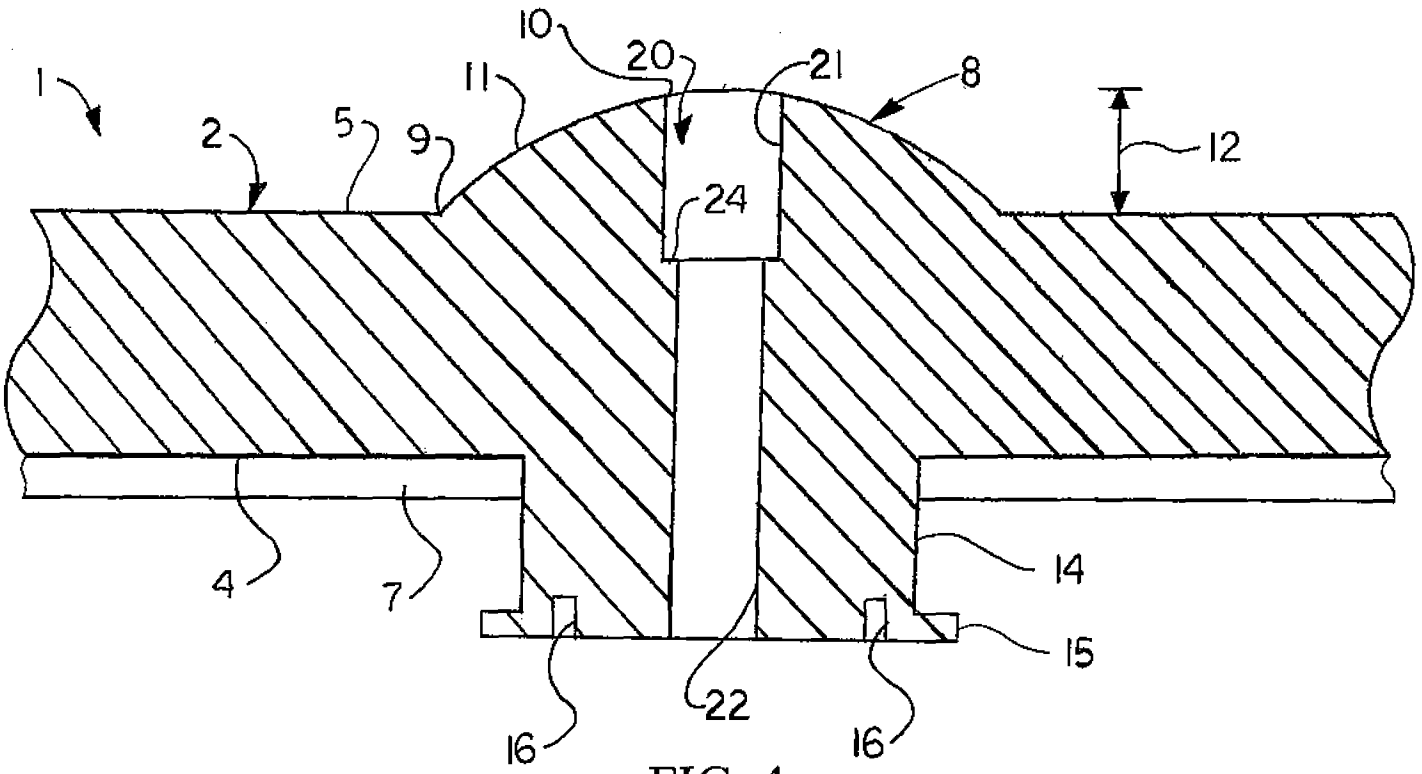
FIG. 4 is an enlarged sectional view of a manhole cover portion of an illustrative embodiment of the vented precipitation guarding manhole cover assemblies.

A manhole cover protrusion 8 protrudes from the exterior manhole cover surface 5 of the manhole cover 2. In some embodiments, the manhole cover protrusion 8 may be substantially centered on the exterior manhole cover surface 5. The manhole cover protrusion 8 may include a protrusion edge 9 which is contiguous with the exterior manhole cover surface 5 of the manhole cover 2. A protrusion surface 11 may be contiguous with and extend from the protrusion edge 9. A protrusion apex 10 may be contiguous with the protrusion surface 11. In some embodiments, the protrusion edge 9 may form a visually-distinguishable indentation or boundary which demarcates the protrusion surface 11 of the manhole cover protrusion 8 from the surrounding exterior manhole cover surface 5. In other embodiments, the protrusion edge 9 may form a gradual and visually-indistinguishable transition from the exterior manhole cover surface 5 to the protrusion surface 11. As used herein, "contiguous" means "sharing a common border; touching". As illustrated in FIG. 4, from the exterior manhole cover surface 5 of the manhole cover 2 at the protrusion edge 9 to the protrusion apex 10, the manhole cover protrusion 8 may have a maximum protrusion thickness 12. In some embodiments, the maximum protrusion thickness 12 may be about ⅝ inch. In other embodiments, the maximum protrusion thickness 12 may be greater or less than about ⅝ inch. The protrusion apex 10 of the manhole cover protrusion 8 may represent the highest point on the entire exterior manhole cover surface 5.

Figure 11:
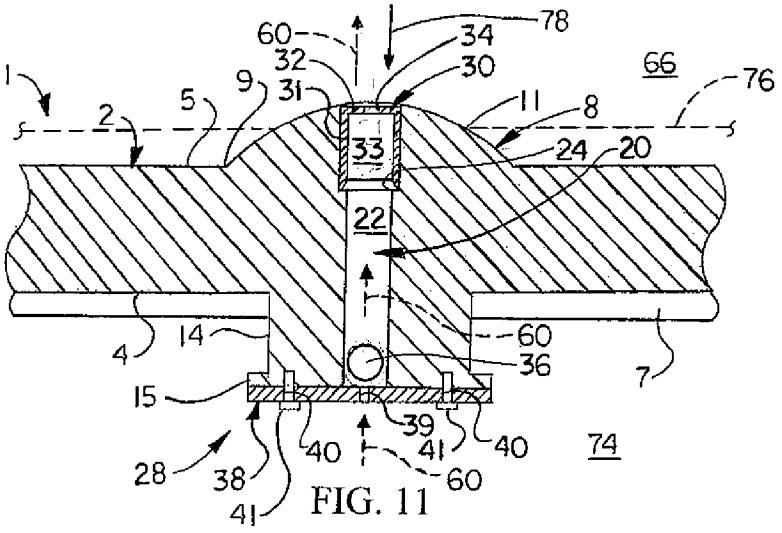
FIG. 11 is an enlarged sectional view of the vented precipitation guarding manhole cover assembly, with the vent valve open and permitting flow of sewer gas from the sanitary sewer through the manhole cover to the atmosphere.

As illustrated in FIG. 11 and will be hereinafter described, the manhole cover protrusion 8 may prevent or minimize entry of pooled precipitation 76 which accumulates on the exterior manhole cover surface 5 of the manhole cover 2 into the sewer 74 through the assembly 1. In some embodiments, the protrusion surface 11 of the manhole cover protrusion 8 may be convex, as illustrated. In other embodiments, the protrusion surface 11 may have a truncated, round, square, faceted or other shape in cross-section and may have an elliptical, triangular, square, polygonal or other alternative shape in top view.

In some embodiments of the assembly 1, a cylindrical manhole cover flange neck 14 may protrude from the interior manhole cover surface 4 of the manhole cover 2, opposite and in substantial alignment with the manhole cover protrusion 8. An annular manhole cover flange 15 may protrude from the manhole cover flange neck 14. As illustrated in FIG. 2, fastener openings 16 may be provided in the manhole cover flange 15 for purposes which will be hereinafter described.

A manhole cover vent opening 20 may extend through the manhole cover protrusion 8, the manhole cover 2, the manhole cover flange neck 14 and the manhole cover flange 15. As illustrated in FIG. 4, the manhole cover vent opening 20 may include an insert seat 21 which extends at least through the manhole cover protrusion 8 and a vent passage 22 which communicates with and extends from the insert seat 21 through the manhole cover 2, the manhole cover flange neck 14 and the manhole cover flange 15, respectively. The vent passage 22 may open at an interior surface of the manhole cover flange 15. The insert seat 21 may have a diameter which is larger than a diameter of the vent passage 22 of the manhole cover vent opening 20. Accordingly, an annular insert seat shoulder 24 may be formed between the insert seat 21 and the vent passage 22. In some embodiments, the manhole cover vent opening 20 may have a maximum diameter or width of about ½ inch. In other embodiments, the manhole cover vent opening 20 may have a maximum diameter or width which is greater or less than ½ inch. The protrusion apex 10 of the manhole cover protrusion 8 may correspond to an outer edge of the insert seat 21 of the manhole cover vent opening 20 at the protrusion surface 11. In some embodiments, the manhole cover 2 may be provided with at least one manhole cover opening (not illustrated) which facilitates selective unseating and removal of the manhole cover 2 from the manhole shoulder 71, typically in the conventional manner.

In some embodiments, the manhole cover protrusion 8, the manhole cover vent opening 20, the manhole cover flange neck 14 and the manhole cover flange 15 may be fabricated integrally in one piece with the manhole cover 2 using casting, molding, machining, stamping and/or other suitable fabrication techniques which are known by those skilled in the art. In other embodiments, the manhole cover protrusion 8, the manhole cover vent opening 20, the manhole cover flange neck 14 and the manhole cover flange 15 may be fabricated separately from and welded or metallurgically, threaded or otherwise mechanically joined to the manhole cover 2 according to the knowledge of those skilled in the art. For example and without limitation, in some embodiments, the manhole cover protrusion 8, the manhole cover vent opening 20, the manhole cover flange neck 14 and the manhole cover flange 15 may be fabricated as an externally-threaded plug (not illustrated) which threadably engages a companion interiorly-threaded plug opening (not illustrated) provided in the manhole cover 2.

Figure 5:
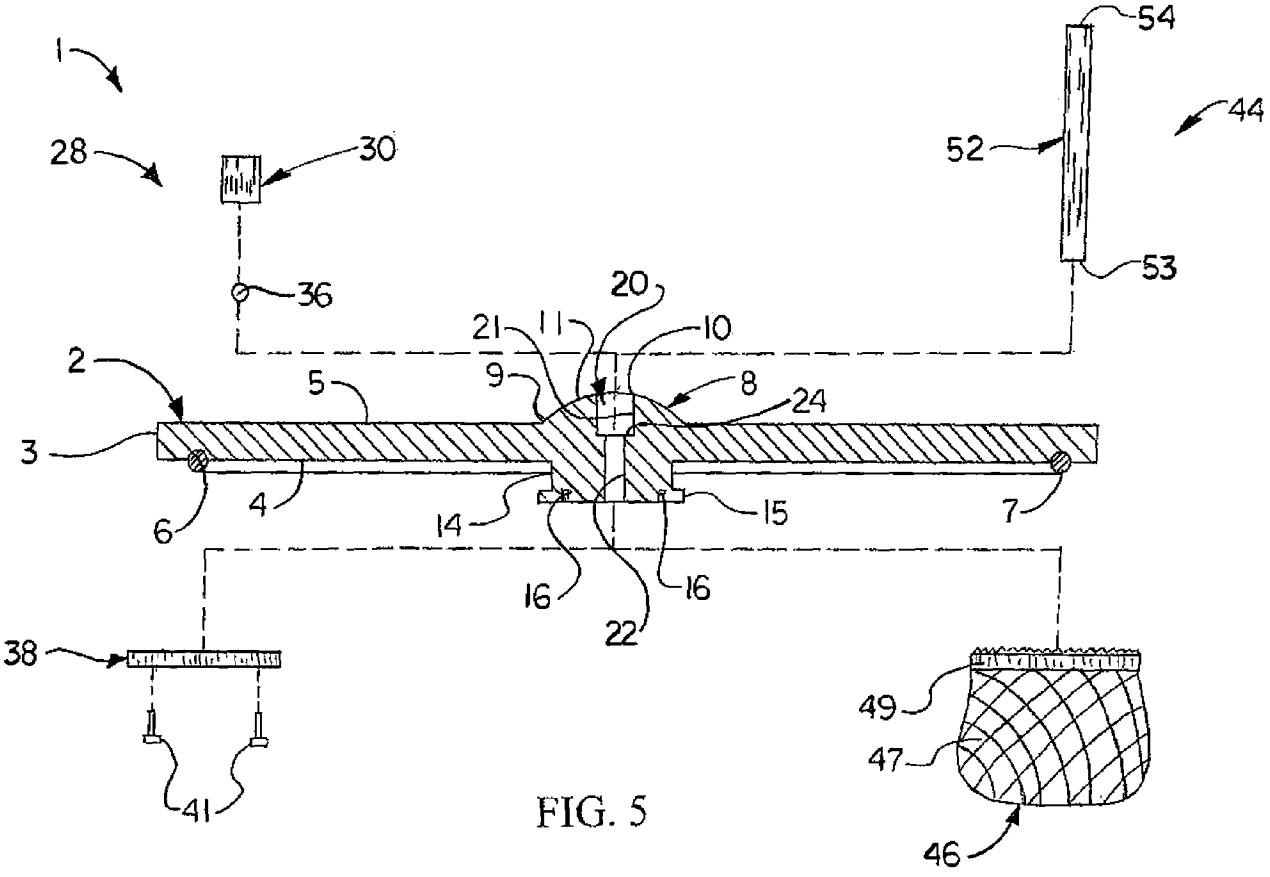
FIG. 5 is an exploded side view of an illustrative embodiment of the vented precipitation guarding manhole cover assemblies, more particularly illustrating a vent valve and a gas discharging assembly including an odor absorbing container and an extension conduit which can be selectively and interchangeably fitted to the manhole cover (illustrated in cross-section) for various applications of the assemblies.

As illustrated in FIG. 5, in some applications of the assembly 1, a vent valve 28 may be disposed in fluid communication with the manhole cover vent opening 20 of the manhole cover 2. In some applications of the assembly 1, a gas deodorizing assembly 44 may be disposed in fluid communication with the manhole cover vent opening 20 of the manhole cover 2. In other applications, the vent valve 20 and the gas deodorizing assembly 44 may be configured for placement in fluid communication with the manhole cover vent opening 20 of the manhole cover 2 in interchangeable relationship to each other. The vent valve 28 may permit venting of sewer gas 60 (FIG. 11) from the sewer 74 to the atmosphere 66 while preventing or minimizing entry of pooled precipitation 76 and/or falling precipitation 78 from the atmosphere 66 into the sewer 74 through the manhole cover vent opening 20. The vent valve 28 may additionally prevent storm water 80 (FIG. 12) from overflowing from the sewer 74 through the vent valve 28 to the exterior manhole cover surface 5 of the manhole cover 2, particularly under heavy precipitation conditions. The gas deodorizing assembly 44 may deodorize odiferous sewer gas 60 (FIG. 15) as it emanates from the sewer 74 through the vent opening 20. Accordingly, deodorized sewer gas 62 may be discharged from the vent opening 20 to the atmosphere 66.

Figure 6:
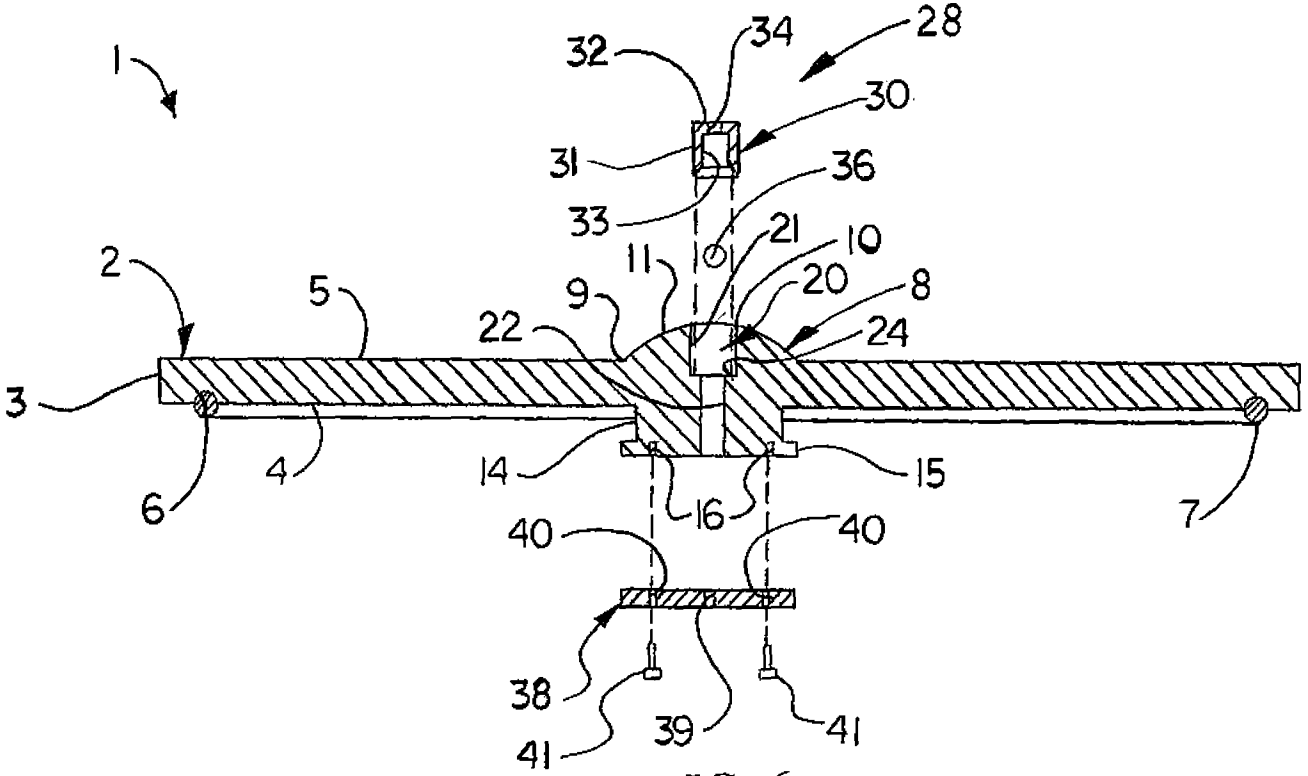
FIG. 6 is an exploded and sectioned side view of an illustrative embodiment of the vented precipitation guarding manhole cover assemblies, more particularly illustrating fitting of the vent valve to the manhole cover in one typical application of the assemblies.
Figure 7:
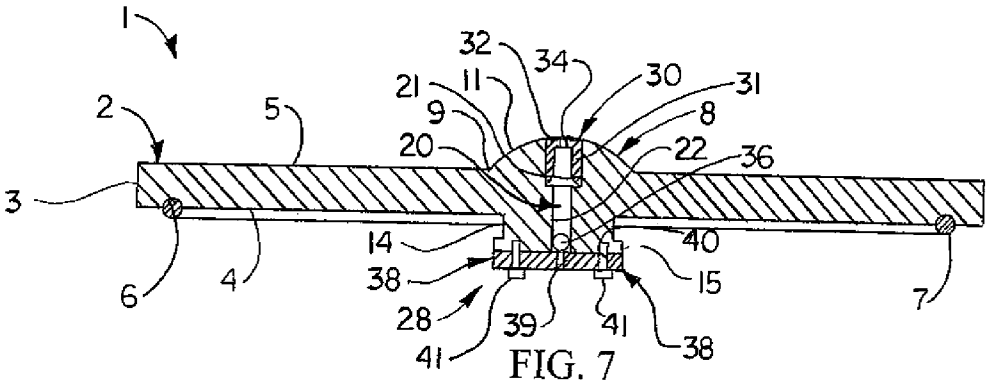
FIG. 7 is a sectioned side view of the exemplary vented precipitation guarding manhole cover assembly fitted with the vent valve illustrated in FIG. 6.
Figure 8:
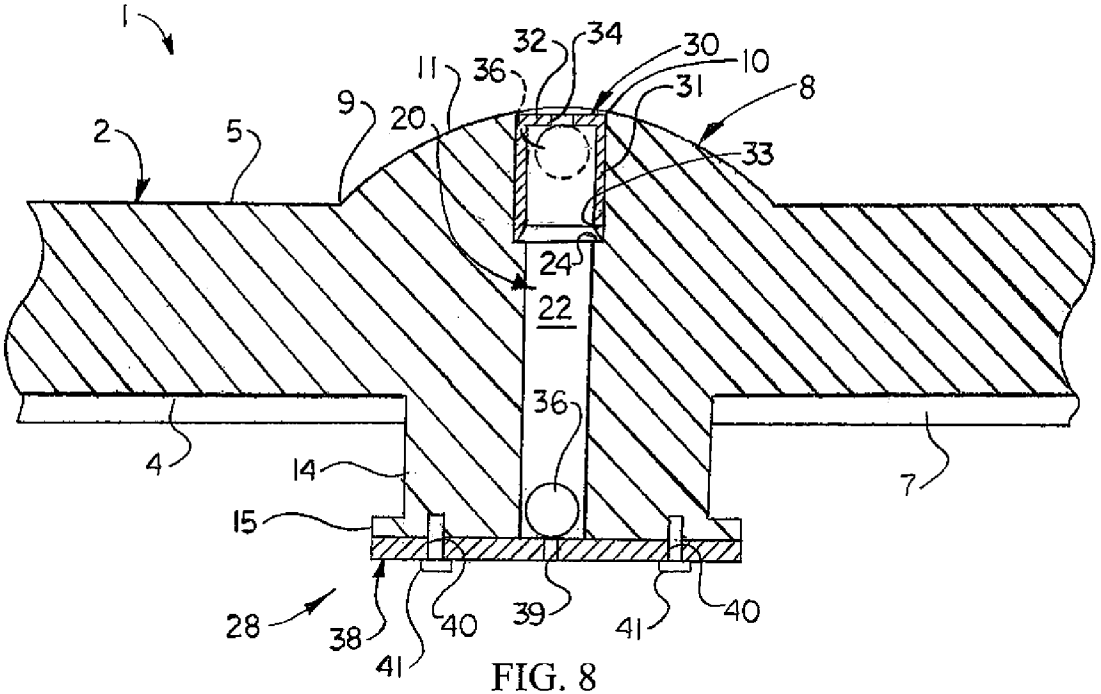
FIG. 8 is an enlarged sectional view of the vented precipitation guarding manhole cover assembly illustrated in FIG. 7, more particularly illustrating alternative positions of a valve ball in the vent valve in typical application of the assembly.
Figure 9:
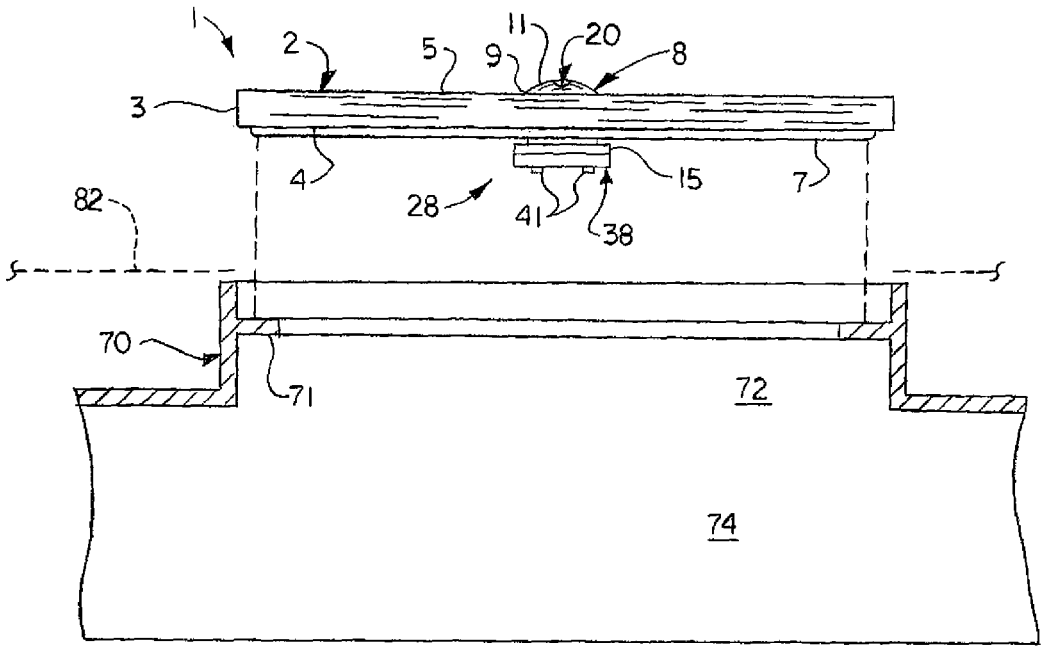
FIG. 9 is an exploded side view of the illustrative vented precipitation guarding manhole cover assembly with the vent valve illustrated in FIG. 6, more particularly illustrating typical placement of the assembly on a manhole flange in a manhole structure over a sanitary sewer in typical application of the assembly.

As particularly illustrated in FIGS. 6-8, in some embodiments, the vent valve 28 may include a valve insert 30 which is sized and configured for insertion into the insert seat 21 of the manhole cover vent opening 20. The valve insert 30 may include a valve insert side wall 31 which may be generally cylindrical. A valve insert end wall 32 may be provided on the valve insert side wall 31. A valve insert interior 33 may be formed by and between the valve insert side wall 31 and the valve insert end wall 32. At least one valve insert vent opening 34 may extend through the valve insert end wall 32. The valve insert vent opening 34 may communicate with the valve insert interior 33. Accordingly, the valve insert 30 may be inserted into the insert seat 21 until the valve insert side wall 31 engages the insert seat shoulder 24 at the junction between the insert seat 21 and the vent passage 22, as illustrated in FIGS. 6-8. In some embodiments, the inner terminal edge of the valve insert side wall 31 may be beveled, as illustrated.

As further illustrated in FIGS. 6-8, the vent valve 28 may further include a valve plate 38 which may be secured to the manhole cover flange 15 on the manhole cover flange neck 14 of the manhole cover 2 according to the knowledge of those skilled in the art. At least one central valve plate vent opening 39 may extend through the valve plate 38. Multiple valve plate fastener openings 40 may extend through the valve plate 38 in a selected number and pattern. As illustrated in FIG. 6, valve plate fasteners 41 may be extended through the respective valve plate fastener openings 40 in the valve plate 38 and threaded into the respective registering fastener openings 16 in the manhole cover flange neck 14 to fasten the valve plate 38 to the manhole cover flange 15 with the valve plate vent opening 39 in the valve plate 38 disposed in registration and fluid communication with the vent passage 22 of the manhole cover vent opening 20, as illustrated in FIGS. 7 and 8.

Figure 12:
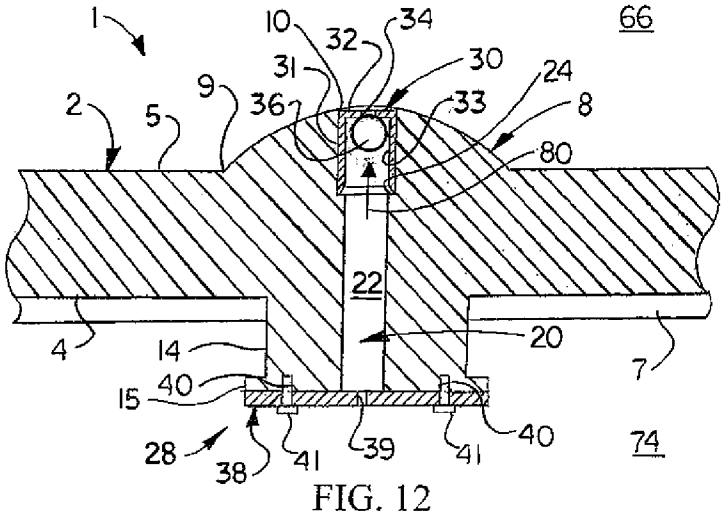
FIG. 12 is an enlarged sectional view of the vented precipitation guarding manhole cover assembly, with the vent valve closed and blocking overflow of storm water from the sanitary sewer through the manhole cover.

The vent valve 28 may further include a valve ball 36 which is disposed within the vent passage 22 of the manhole cover vent opening 20 and the valve insert interior 33 of the valve insert 30. The valve ball 36 may be fabricated of plastic and/or other lightweight, buoyant material. As illustrated in FIG. 8, in typical operation of the vent valve 28, which will be hereinafter described, the valve ball 36 may be normally deployed by gravity in the lower position indicated in solid lines in FIG. 8. Accordingly, the valve ball 36 may close or block the valve plate vent opening 39 in the valve plate 38 from the vent passage 22 of the manhole cover vent opening 20 to pooled precipitation 76 and/or falling precipitation 78 which may enter the manhole cover vent opening 20 and otherwise enter the sewer 74. As illustrated in FIG. 11, in the lower position, the valve ball 36 may facilitate venting of sewer gas 60 from the sewer 74 through the vent valve 28 and manhole cover 2 to the atmosphere 66. The sewer gas 60 may flow first through the valve plate vent opening 39 in the valve plate 38 and then between the bottom of the valve ball 36 and the valve plate 38 and between the sides of the valve ball 36 and the interior surfaces of the vent passage 22, and finally through the valve insert interior 33 of the valve insert 30, from which the sewer gas 60 is discharged through the valve insert vent opening 34 to the atmosphere 66. Responsive to the upward pressure of the inflowing sewer gas 60, the valve ball 36 may partially "float" within the vent passage 22 to permit flow of the sewer gas 60 from the sewer 74 into the manhole cover vent opening 20. In the lower position, the valve ball 36 may prevent or minimize influx of pooled precipitation 76 and/or falling precipitation 78 through the vent valve 28 and into the sewer 74, as noted above. As illustrated in FIG. 12, responsive to rising storm water 80 in the manhole cover vent opening 20, in the upper position, the valve ball 36 may seat against the valve insert end wall 32 and close or seal the valve insert vent opening 34 in the valve insert 30 from the valve insert interior 33 of the vent valve 28 to prevent the storm water 80 from overflowing from the sewer 74 through the vent valve 28 to the exterior manhole cover surface 5 of the manhole cover 2, respectively, particularly under heavy precipitation conditions.

Figure 13:
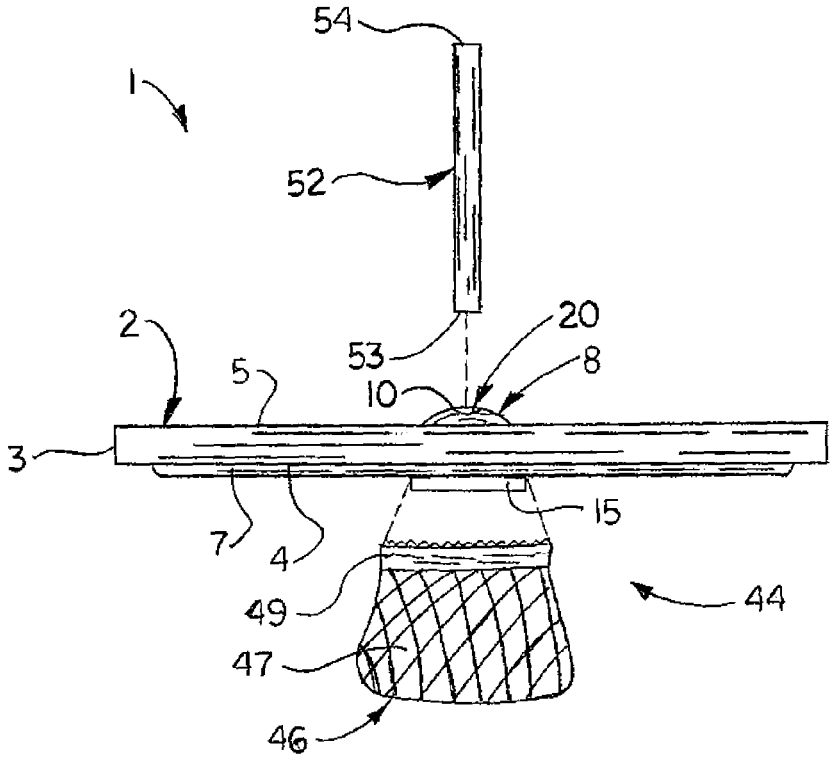
FIG. 13 is an exploded side view of an illustrative embodiment of the vented precipitation guarding manhole cover assemblies, more particularly illustrating fitting of the extension conduit and the odor-absorbing container of the gas discharging assembly to the manhole cover in another typical application of the vented precipitation guarding manhole cover assemblies.
Figure 14:
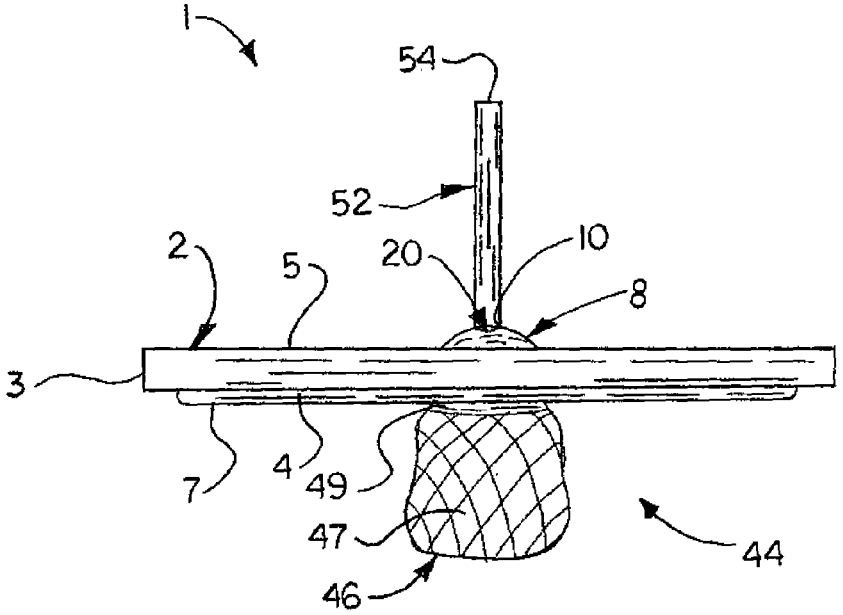
FIG. 14 is a side view of the illustrative vented precipitation guarding manhole cover assembly illustrated in FIG. 13, with the extension conduit and the odor absorbing container fitted to the manhole cover.
Figure 15:
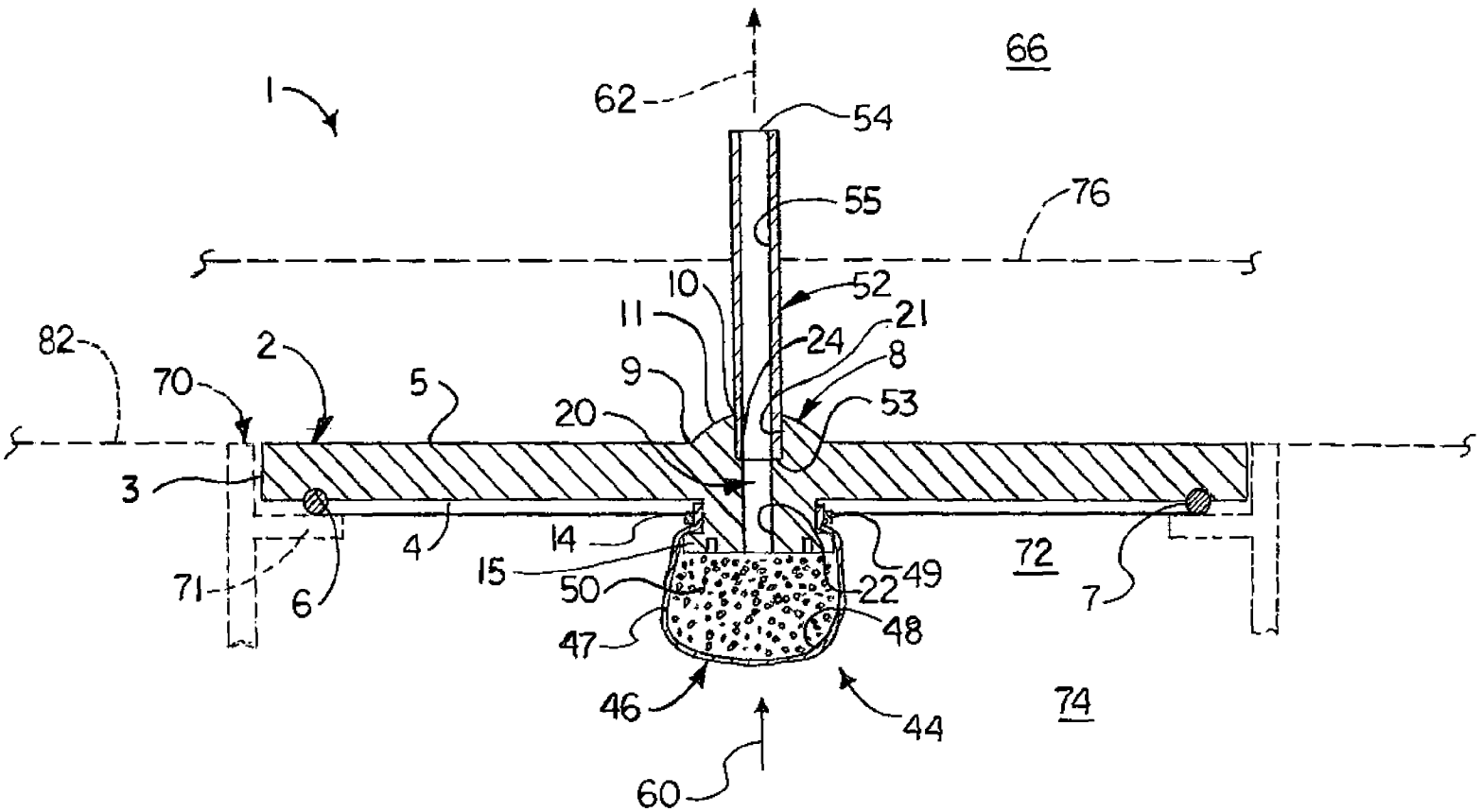
FIG. 15 is a sectional view of the vented precipitation guarding manhole cover assembly illustrated in FIG. 14, more particularly illustrating typical flow and deodorization of sewer gas from the sanitary sewer through the odor absorbing container, the manhole cover and the extension conduit, respectively, to the atmosphere.

As illustrated in FIGS. 13-15, in some embodiments, the gas deodorizing assembly 44 may include an odor absorbing container 46 which may be attached to the manhole cover 2 according to the knowledge of those skilled in the art. The odor absorbing container 46 may include a container wall 47. In some embodiments, the container wall 47 may include a bag-shaped enclosure having a flexible gas-permeable or semi-permeable material such as a fabric material, for example and without limitation. One non-limiting example of a material which is suitable for fabrication of the container wall 47 includes a mesh polyethylene material.

The container wall 47 of the odor absorbing container 46 may be attached to the manhole cover 2 according to the knowledge of those skilled in the art. In some embodiments, a container securing band 49 may be provided on the container wall 47 of the odor absorbing container 46. The container securing band 49 may facilitate attachment of the container wall 47 to the manhole cover flange neck 14 and/or to the manhole cover flange 15 of the manhole cover 2. In some embodiments, the container securing band 49 may include an elastic material. In some embodiments, the container securing band 49 may be secured using hook and loop fasteners, snaps, clamps, mechanical fasteners and/or other suitable fastening mechanism known by those skilled in the art.

As illustrated in FIG. 15, the container wall 47 of the odor absorbing container 46 may enclose a container interior 48 which is disposed in fluid communication with the vent passage 22 of the manhole cover vent opening 20 in the manhole cover 2. An odor absorbing material 50 may be provided in the container interior 48. The odor absorbing material 50 may include any type of particulate and/or non-particulate material which is capable of absorbing at least some of the odiferous chemicals, compounds or components in the odiferous sewer gas 60 from the sewer gas 60 as the sewer gas 60 flows from the sewer 74 through the odor absorbing container 46 and the manhole cover vent opening 20 in the manhole cover 2, respectively, to the atmosphere 66. For example and without limitation, in some embodiments, the odor absorbing material 50 may include sawdust.

In some embodiments, the container wall 47 of the odor absorbing container 46 may be generally bowl-shaped or semi-spherical and may be fabricated of a rigid or semi-rigid material. The container wall 47 may include steel, aluminum, carbon fiber composite, inert plastic or other suitable material, or any combination thereof. At least one gas opening (not illustrated) may extend through the container wall 47. The container wall 47 may be adapted for attachment to the manhole cover 2 such as via the manhole cover flange neck 14, the manhole cover flange 15 and/or via any other suitable attachment structure, mechanism or technique which is known by those skilled in the art. Non-limiting examples of techniques which are suitable for attaching the container wall 47 of the odor absorbing container 46 to the manhole cover 2 are described in U.S. Pat. No. 8,851,791, which is incorporated by reference herein in its entirety.

As further illustrated in FIGS. 13-15, in some embodiments, the gas deodorizing assembly 44 may further include an elongated extension conduit 52 which is placed in fluid communication with the manhole cover vent opening 20 of the manhole cover 2. In some embodiments, the extension conduit 52 may be configured to seat in the insert seat 21 in fluid communication with the vent passage 22 of the manhole cover vent opening 20. Accordingly, the extension conduit 52 may interface with the manhole cover vent opening 20 in interchangeable relationship to the valve insert 30 of the vent valve 28. The extension conduit 52 may have an extension conduit inlet end 53 which inserts into the insert seat 21 and seats against the insert seat shoulder 24 between the insert seat 21 and the vent passage 22 in the manhole cover vent opening 20 and an extension conduit outlet end 54 which is opposite the extension conduit inlet end 53. A conduit bore 55 may traverse the length of the extension conduit 52 from the extension conduit inlet end 53 to the extension conduit outlet end 54. Accordingly, the extension conduit 52 may facilitate venting of sewer gas 60 from the sewer 74 through the manhole cover vent opening 20 to the atmosphere 66 while preventing pooled precipitation 76 which may accumulate to a high level on the exterior manhole cover surface 5 of the manhole cover 2 from entering the sewer 74 through the manhole cover vent opening 20. In some applications of the assembly 1, the extension conduit 52 may be used in combination with the odor absorbing container 46. In other applications, each of the odor absorbing container 46 and the extension conduit 52 may be used independently of the other.

Referring next to FIGS. 9-12 of the drawings, in typical application, the manhole cover 2 of the assembly 1 may be installed in a manhole opening 72 in a manhole structure 70 which extends through the ground or a roadway surface 82 (FIG. 10) and communicates with the subterranean sanitary sewer 74. In some applications, the manhole opening 72 may be circumscribed by a manhole shoulder 71. The manhole structure 70 may include steel, iron or other metal. The assembly 1 is placed in the manhole opening 72 with the manhole cover seal 7 on the manhole cover 2 resting on the manhole shoulder 71. In some applications, the manhole cover 2 may be bolted and/or otherwise fixedly secured over the manhole opening 72 according to the knowledge of those skilled in the art. The exterior manhole cover surface 5 of the manhole cover 2 may be generally flush with the ground or roadway surface 82. As illustrated in FIG. 10, in some embodiments, the protrusion surface 11 on the manhole cover protrusion 8 enables an automobile wheel 84 of an automobile (not illustrated) to easily traverse the assembly 1 as the automobile wheel 84 traverses the ground or roadway surface 82.

In some applications of the assembly 1, both the vent valve 28 and the gas deodorizing assembly 44 (FIG. 5) may be omitted from the manhole cover vent opening 20 and the manhole cover 2 may be seated in the manhole opening 72. Sewer gas 60 (FIG. 11) may escape the sewer 74 to the atmosphere 66 through the manhole cover vent opening 20. The quantity of falling precipitation 78 which can enter the vent opening 20 is substantially limited by the diameter or width of the manhole cover vent opening 20. In the event that the falling precipitation 78 forms pooled precipitation 76 which accumulates or pools on the ground or roadway surface 82 (FIG. 10) and on the exterior manhole cover surface 5 of the manhole cover 2, the height of the protrusion apex 10 of the manhole cover protrusion 8 beyond the plane of the exterior manhole cover surface 5 of the manhole cover 2 and the ground or roadway surface 82 additionally limits the quantity of the pooled precipitation 76 which can enter the sewer 74 by preventing the pooled precipitation 76 from flowing into the manhole cover vent opening 20 until the depth of the pooled precipitation 76 exceeds the height of the protrusion apex 10. The pooled precipitation 76 tends to flow around rather than over the manhole cover protrusion 8.

As further illustrated in FIGS. 9-12, in some applications, the vent valve 28 may be installed in the manhole cover 2 typically as was heretofore described with respect to FIGS. 5-8. As illustrated in FIGS. 7 and 8, the valve ball 36 of the vent valve 28 normally seats by gravity on the valve plate 28 and substantially closes the valve plate vent opening 39 to pooled precipitation 76 and/or falling precipitation 78 (FIG. 11) which may enter the manhole cover vent opening 20. Accordingly, as illustrated in FIG. 11, sewer gas 60 may rise from the sewer 74 and flow initially through the valve plate vent opening 39 and then beneath and around the valve ball 36 and through the vent passage 22 of the manhole cover vent opening 20 and the valve insert interior 33 of the valve insert 30, respectively, discharging through the valve insert vent opening 34 in the valve insert end wall 32 of the valve insert 30 to the atmosphere 66.

As further illustrated in FIG. 11, during rainfall or other falling precipitation 78, as during no precipitation, the valve ball 36 of the vent valve 28 may normally seat by gravity on the valve plate 38 (indicated in solid lines in FIG. 8) but still facilitate venting of sewer gas 60 from the sewer 74 to the atmosphere 66, as was heretofore described. A small portion of the falling precipitation 78, the quantity of which is substantially limited by the diameter or width of the manhole cover vent opening 20, may be capable of entering the manhole cover vent opening 20. However, the falling precipitation 78 may impart weight to the valve ball 36, which seats against the valve plate vent opening 39 and prevents or substantially limits the quantity of falling precipitation 78 which can enter the sewer 74. The height of the protrusion apex 10 of the manhole cover protrusion 8 beyond the plane of the exterior manhole cover surface 5 of the manhole cover 2 and the ground or roadway surface 82 additionally limits the quantity of the pooled precipitation 76 which can enter the sewer 74 by preventing the pooled precipitation 76 from flowing into the manhole cover vent opening 20 until the depth of the pooled precipitation 76 exceeds the height of the protrusion apex 10.

As illustrated in FIG. 12, under heavy precipitation conditions, storm water 80 may rise in the sewer 74. In some applications, the manhole cover 2 may have been bolted to the underlying manhole structure 70, and the manhole cover seal 7 imparts a fluid-tight seal between the manhole cover 2 and the manhole shoulder 71. The storm water 80 may have a tendency to rise through the valve plate vent opening 39 in the valve plate 38 of the vent valve 28, the manhole cover vent opening 20 of the manhole cover 2 and the valve insert interior 33 of the valve insert 30, respectively, and otherwise finally discharge through the valve insert vent opening 34 to the exterior manhole cover surface 5 and the ground or roadway surface 82. As it rises in the manhole cover vent opening 20, however, the rising storm water 80 floats the valve ball 36 in the vent passage 22 and into the valve insert interior 33 of the valve insert 30, ultimately causing the valve ball 36 to seat against the valve insert end wall 32 of the valve insert 30. Accordingly, the valve ball 36 seals the valve insert vent opening 34 from the manhole cover vent opening 20 and prevents the storm water 80, and raw sewage in the storm water 80, from discharging through the valve insert vent opening 34 to the ground or roadway surface 82.

It will be appreciated by those skilled in the art that the assembly 1 prevents a substantial portion of falling precipitation 78 and/or pooled precipitation 76 from entering the sewer 74 through the manhole opening 72. The assembly 1 may facilitate escape of sewer gas 60 from the sewer 74 to the atmosphere 66 under normal weather conditions as well as during light rainfall or other falling precipitation 78. The vent valve 28 of the assembly 1 prevents storm water 80 from overflowing from the sewer 74 and discharging to the ground or roadway surface 82, particularly in applications in which the manhole cover 2 is bolted and/or otherwise secured in the manhole opening 72. The assembly 1 may prevent application of a vacuum seal to the manhole cover 2, rendering ease in removal of the manhole cover 2 from the manhole opening 72. The assembly 1 may prevent rusting of the manhole cover 2 to the underlying manhole shoulder 71, also rendering ease in removal of the manhole cover 2 from the manhole opening 72. The assembly 1 may additionally prevent or reduce rattling of the manhole cover 2 as the automobile wheel 84 (FIG. 10) traverses the manhole cover 2 and the assembly 1.

Referring next to FIGS. 13-15 of the drawings, in some applications, the gas discharging assembly 44 may be installed in the manhole cover 2 typically as was heretofore described with respect to FIGS. 13-15. The assembly 1 with the gas discharging assembly 44 may be installed in a manhole opening 72 in a manhole structure 70 which extends through the ground or a roadway surface 82 and communicates with the subterranean sanitary sewer 74, as illustrated in FIG. 15.

Sewer gas 60 may normally emanate from the sewer 74 through the porous or semi-porous container wall 47 and the odor absorbing material 50 in the container interior 48 of the odor absorbing container 46, respectively, and then through the vent passage 22 and the insert seat 21, respectively, of the manhole cover vent opening 20, and discharged to the atmosphere 66. The odor absorbing material 50 in the odor absorbing container 46 may absorb a substantial quantity of the odiferous chemicals, compounds or components in the sewer gas 60. Consequently, deodorized sewer gas 62 may rise from the insert seat 21 of the manhole cover vent opening 20 to the atmosphere 66. Because the odor absorbing material 50 in the odor absorbing container 46 may absorb a substantial quantity of the odiferous chemicals, compounds or components in the sewer gas 60 from the sewer 74, the otherwise objectionable smell of the sewer gas 60 in the atmosphere 66 may be eliminated or at least substantially reduced.

As further illustrated in FIGS. 13-15, in some applications, the extension conduit 52 may be seated in the insert seat 21 in fluid communication with the vent passage 22 of the valve seat 20. Accordingly, the extension conduit 52 may be self-standing in the insert seat 21, and the sewer gas 60 may be vented from the sewer 74 through the manhole cover vent opening 20 and the extension conduit 52 to the atmosphere 66. The extension conduit 52 may prevent pooled precipitation 76 which accumulates to a high level on the ground or roadway surface 82 and the exterior manhole cover surface 5 of the manhole cover 2 from entering the sewer 74 through the manhole cover vent opening 20. In some applications of the assembly 1, the extension conduit 52 may be used in combination with the odor absorbing container 46. In other applications, each of the odor absorbing container 46 and the extension conduit 52 may be used independently of the other.

It will be appreciated by those skilled in the art that the odor absorbing material 50 in the container interior 48 of the odor absorbing container 46 may be periodically replaced, as deemed necessary, by removing the container wall 47 typically from the manhole cover flange 15 such as by releasing the container securing band 49; removing the used odor absorbing material 50 from the container interior 48; placing fresh or replacement odor absorbing material 50 in the container interior 48; reattaching the container wall 47 to the manhole cover flange 15 typically by re-securing the container securing band 49; and replacing the manhole cover 2 in the manhole opening 72, respectively.

It will be further appreciated by those skilled in the art that in some applications of the assembly 1, the manhole cover 2 can be deployed in the manhole opening 72 either alone or in combination with the vent valve 28, the odor absorbing container 46 of the gas deodorizing assembly 44 and the extension conduit 52. In other applications of the assembly 1, the vent valve 28 can be used in combination with the odor absorbing container 46 of the gas deodorizing assembly 44. Accordingly, the odor absorbing container 46 may be attached to the manhole cover flange neck 14 and/or the manhole cover flange 15 beneath the valve plate 38. The assembly 1 may then both prevent or minimize entry of pooled precipitation 76 and/or pooled precipitation 78 (FIG. 11) into the sewer 74 and deodorize the odiferous sewer gas 60 and discharge the deodorized sewer gas 62 (FIG. 15) into the atmosphere 66. In still other applications of the assembly 1, the extension conduit 52 may be used in combination with the vent valve 28, with or without the odor absorbing container 46. Accordingly, the insert seat 21 of the manhole cover vent opening 20 may be suitably sized to accept both the valve insert 30 of the vent valve 28, as illustrated in FIGS. 6-8, and the conduit inlet end 53 of the extension conduit 52, as illustrated in FIGS. 13-15. When thusly configured, the assembly 1 may additionally prevent or minimize influx of pooled precipitation 76 which reaches a high level above the ground or roadway surface 82 and the exterior manhole cover surface 5 of the manhole cover 2 into the manhole cover vent opening 20, as was heretofore described with respect to FIG. 15.

Figure 16:
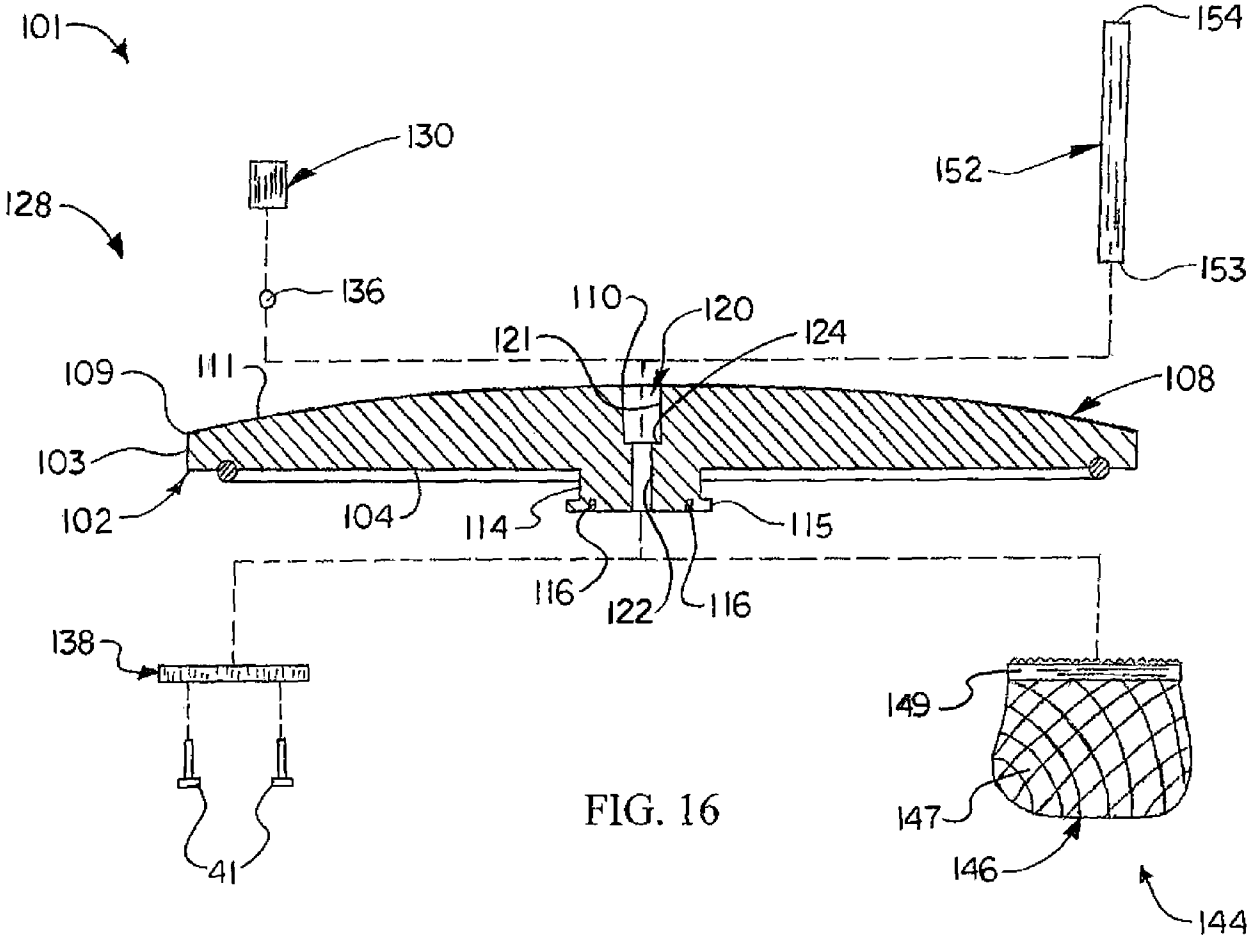
FIG. 16 is an exploded side view of an alternative illustrative embodiment of the vented precipitation guarding manhole cover assemblies, more particularly illustrating selective and interchangeable attachment of a vent valve and a gas discharging assembly including an odor-absorbing container and an extension conduit to the manhole cover (illustrated in cross-section) for various applications of the assembly.

Referring next to FIG. 16 of the drawings, an alternative illustrative embodiment of the vented precipitation guarding manhole cover assembly, hereinafter assembly, is generally indicated by reference numeral 101. In the assembly 101, elements which are analogous to the respective elements of the assembly 1 that was heretofore described with respect to FIGS. 1-15 are designated by the same respective numerals in the 100-199 series in FIG. 16. The manhole cover protrusion 108 may cover substantially the entire exterior manhole cover surface of the manhole cover protrusion 108. Accordingly, the protrusion edge 109 of the manhole cover protrusion 108 may form the junction between the manhole cover edge 103 and the manhole cover protrusion 108. The protrusion surface 111 may be generally convex in cross-section and extends from the protrusion edge 109 to the protrusion apex 110 typically at the edge of the manhole cover vent opening 120. In other embodiments, the protrusion surface 111 may have a truncated, round, square, octagonal or other shape in cross-section.

Exemplary application of the assembly 101 may be as was heretofore described with respect to the assembly 1 in FIGS. 1-11. Accordingly, the vent valve 128 can be assembled by insertion of the valve insert 130 into the insert seat 121 of the vent opening 120 and attachment of the valve plate 138 typically to the manhole cover flange 115. The vent valve 128 may facilitate flow of sewer gas 60 (FIG. 11) from the sewer 74 to the atmosphere 66. Additionally, the vent valve 128 may prevent or substantially minimize entry of pooled precipitation 76 (FIG. 11) from the exterior manhole cover surface 5 and/or falling precipitation 78 (FIG. 11) from the atmosphere 66 through the manhole cover vent opening 20 into the sewer 74. The vent valve 128 may prevent or substantially minimize overflow of storm water 80 (FIG. 12) from the sewer 74 through the manhole cover vent opening 20 to the exterior surface of the manhole cover 102. The relatively small diameter of the vent passage 122 (½ inch in some embodiments) may substantially limit the quantity of falling precipitation 178 and/or pooled precipitation 176 which is capable of entering the sewer 174 through the manhole cover vent opening 20. Additionally, the raised profile of the protrusion apex 110 of the manhole cover protrusion 108 substantially limits the quantity of pooled precipitation 176 and/or falling precipitation 178 which can flow from the protrusion surface 111 of the manhole cover 102 through the vent opening 120 and into the sewer 174.

Additionally or alternatively, the gas deodorizing assembly 144 may be assembled by attachment of the odor absorbing container 146 typically to the manhole cover flange 115. Accordingly, the gas deodorizing assembly 144 deodorizes odiferous sewer gas 60 (FIG. 15) from the sewer 74 and deodorized sewer gas 62 is discharged from the manhole cover vent opening 20 into the atmosphere 66. Additionally or alternatively, the extension conduit 152 can be deployed in the vent opening 120. Accordingly, the extension conduit 152 may facilitate venting of sewer gas 60 from the sewer 74 through the vent opening 120 to the atmosphere 66 while preventing pooled precipitation 76 which accumulates to a high level on the protrusion surface 111 of the manhole cover protrusion 108 from entering the sewer 74 through the vent opening 120.

While certain illustrative embodiments of the disclosure have been described above, it will be recognized and understood that various modifications can be made to the embodiments and the appended claims are intended to cover all such modifications which may fall within the spirit and scope of the disclosure.

What is claimed is:

1. A vented precipitation guarding manhole cover assembly, comprising:

a manhole cover having a generally planar exterior manhole cover surface;

a manhole cover protrusion extending from the exterior manhole cover surface, the manhole cover protrusion having:

a protrusion edge contiguous with the exterior manhole cover surface;

a protrusion surface contiguous with and extending from the protrusion edge; and a protrusion apex contiguous with the protrusion surface;

a manhole cover vent opening extending through the manhole cover protrusion and the manhole cover;

a vent valve and a gas deodorizing assembly configured for placement in fluid communication with the manhole cover vent opening of the manhole cover; and wherein the vent valve comprises a valve insert configured to be seated in the manhole cover vent opening, a valve insert vent opening in the valve insert for placement in fluid communication with the manhole cover vent opening, a valve plate configured to be carried by the manhole cover, a valve plate vent opening in the valve plate for placement in fluid communication with the manhole cover vent opening and a valve ball configured for placement in the manhole cover vent opening.

2. The vented precipitation guarding manhole cover assembly of claim 1 further comprising a manhole cover flange neck carried by the manhole cover and a manhole cover flange carried by the manhole cover flange neck, and wherein the manhole cover vent opening extends through the manhole cover flange neck and the manhole cover flange.

3. The vented precipitation guarding manhole cover assembly of claim 1 wherein the protrusion surface of the manhole cover protrusion is convex.

4. The vented precipitation guarding manhole cover assembly of claim 1 wherein the manhole cover protrusion is substantially centered on the exterior manhole cover surface.

5. The vented precipitation guarding manhole cover assembly of claim 1 further comprising at least one manhole cover seal carried by the manhole cover.

6. The vented precipitation guarding manhole cover assembly of claim 1 wherein the manhole cover protrusion is integral with the exterior manhole cover surface.

7. The vented precipitation guarding manhole cover assembly of claim 1 further comprising a vent valve disposed in fluid communication with the manhole cover vent opening of the manhole cover.

8. The vented precipitation guarding manhole cover assembly of claim 1 further comprising a gas deodorizing assembly disposed in fluid communication with the manhole cover vent opening of the manhole cover.

9. The vented precipitation guarding manhole cover assembly of claim 1 further comprising an extension conduit configured for placement in fluid communication with the manhole cover vent opening of the manhole cover.

10. A vented precipitation guarding manhole cover assembly, comprising:

a manhole cover having a generally planar exterior manhole cover surface;

a manhole cover protrusion extending from the exterior manhole cover surface, the manhole cover protrusion having:

a protrusion edge contiguous with the exterior manhole cover surface;

a protrusion surface contiguous with and extending from the protrusion edge; and a protrusion apex contiguous with the protrusion surface;

a manhole cover vent opening extending through the manhole cover protrusion and the manhole cover;

a vent valve and a gas deodorizing assembly configured for placement in fluid communication with the manhole cover vent opening of the manhole cover; and wherein the gas deodorizing assembly comprises an odor absorbing container carried by the manhole cover, the odor absorbing container disposed in fluid communication with the manhole cover vent opening in the manhole cover, and an odor absorbing material in the odor absorbing container.

11. A vented precipitation guarding manhole cover assembly, comprising:

a manhole cover having an interior manhole cover surface, a generally planar exterior manhole cover surface and an annular manhole cover edge circumscribing the interior manhole cover surface and the exterior manhole cover surface;

a manhole cover protrusion extending from the exterior manhole cover surface, the manhole cover protrusion having:

a protrusion edge contiguous with the exterior manhole cover surface;

a protrusion surface contiguous with and extending from the protrusion edge; and a protrusion apex contiguous with the protrusion surface;

a manhole cover flange neck carried by the interior manhole cover surface of the manhole cover;

a manhole cover flange carried by the manhole cover flange neck;

a manhole cover vent opening extending through the manhole cover protrusion, the manhole cover, the manhole cover flange neck and the manhole cover flange;

a vent valve and a gad deodorizing assembly configured for placement in fluid communication with the manhole cover vent opening of the manhole cover; and wherein the vent valve comprises a valve insert configured to be seated in the manhole cover vent opening, a valve insert vent opening in the valve insert for placement in fluid communication with the manhole cover vent opening, a valve plate configured to be carried by the manhole cover, a valve plate vent opening in the valve plate for communication with the manhole cover vent opening and a valve ball configured for placement in the manhole cover vent opening.

12. The vented precipitation guarding manhole cover assembly of claim 11 wherein the gas deodorizing assembly comprises an odor absorbing container carried by the manhole cover, the odor absorbing container disposed in fluid communication with the manhole cover vent opening in the manhole cover, and an odor absorbing material in the odor absorbing container.

13. A vented precipitation guarding manhole cover assembly, comprising:

a manhole cover having an interior manhole cover surface, a generally planar exterior manhole cover surface and an annular manhole cover edge circumscribing the interior manhole cover surface and the exterior manhole cover surface;

a manhole cover protrusion extending from the exterior manhole cover surface, the manhole cover protrusion having:

a protrusion edge contiguous with the exterior manhole cover surface, the protrusion edge demarcating the manhole cover protrusion from the exterior manhole cover surface;

a protrusion surface contiguous with and extending from the protrusion edge; and a protrusion apex contiguous with the protrusion surface;

a manhole cover flange neck carried by the interior manhole cover surface of the manhole cover;

a manhole cover flange carried by the manhole cover flange neck;

a manhole cover vent opening including:

an insert seat extending at least through the manhole cover protrusion;

a vent passage communicating with the insert seat and extending through the manhole cover, the manhole cover flange neck and the manhole cover flange; and an insert seat shoulder between the insert seat and the vent passage;

a vent valve and a gas deodorizing assembly configured for interchangeable placement in fluid communication with the manhole cover vent opening of the manhole cover, the vent valve including:

a valve insert configured to be seated in the insert seat of the manhole cover vent opening;

a valve insert vent opening in the valve insert for placement in fluid communication with the manhole cover vent opening;

a valve plate configured to be carried by the manhole cover;

a valve plate vent opening in the valve plate for placement in fluid communication with the manhole cover vent opening; and a valve ball configured for placement in the manhole cover vent opening; and the gas deodorizing assembly including:

an odor absorbing container carried by the manhole cover, the odor absorbing container having:

a generally gas-permeable container wall carried by at least one of the manhole cover flange neck and the manhole cover flange;

a container interior formed by the container wall and disposed in fluid communication with the manhole cover vent opening in the manhole cover; and an odor absorbing material in the odor absorbing container.

14. The vented precipitation guarding manhole cover assembly of claim 13 further comprising an extension conduit configured for placement in the insert seat of the manhole cover vent opening of the manhole cover in interchangeable relationship to the valve insert of the vent valve.

15. The vented precipitation guarding manhole cover assembly of claim 13 wherein the protrusion surface of the manhole cover protrusion is convex.

16. A vented precipitation guarding manhole cover assembly, comprising:

a manhole cover including:

an exterior manhole cover surface;

an interior manhole cover surface;

a manhole cover edge circumscribing the exterior manhole cover surface and the interior manhole cover surface;

a manhole cover protrusion extending from the exterior manhole cover surface, the manhole cover protrusion having:

a protrusion edge contiguous with the manhole cover edge;

a generally convex protrusion surface contiguous with and extending from the protrusion edge; and, a protrusion apex contiguous with the protrusion surface;

a manhole cover vent opening extending through the manhole cover protrusion and the manhole cover;

a manhole cover flange neck extending from the interior manhole cover surface, the manhole cover vent opening extending through the manhole cover flange neck; and a manhole cover flange carried by the manhole cover flange neck.

* * * * *